US005772194A

United States Patent [19]

Huebler et al.

[11] Patent Number: 5,772,194

[45] Date of Patent: Jun. 30, 1998

[54] SHEET MATERIAL INSERTER HAVING CONTROLLABLE OPTICAL FEED OF SHEET MATERIAL AND ENVELOPES VIA MULTIPLE STATION FEEDERS

[75] Inventors: Uwe Huebler; Wilfried Kopanski; Klaus Gettwart, all of Berlin, Germany

[73] Assignee: Francotyp-Postalia AG & Co., Birkenwerder, Germany

[21] Appl. No.: 533,216

[22] Filed: Sep. 22, 1995

Related U.S. Application Data

[63] Continuation of Ser. No. 392,223, Feb. 22, 1995, abandoned.

[30] Foreign Application Priority Data

Mar. 4, 1994 [DE] Germany ..... 44 07 871.4

[51] Int. Cl.[6] ..... B42C 1/00; B65H 39/02

[52] U.S. Cl. ..... 270/45; 270/58.06

[58] Field of Search ..... 270/58.01, 58.06, 270/32, 45

[56] References Cited

U.S. PATENT DOCUMENTS

| | | | |
|---|---|---|---|
| 3,059,391 | 10/1962 | Volks et al. | 270/58.06 X |
| 3,253,384 | 5/1966 | Huck et al. . | |
| 3,962,848 | 6/1976 | Hankins . | |
| 3,965,644 | 6/1976 | Stocker | 270/58.06 X |
| 4,077,118 | 3/1978 | Asher et al. . | |
| 4,640,506 | 2/1987 | Luperti et al. . | |
| 4,674,258 | 6/1987 | Ehlscheid et al. . | |
| 4,707,790 | 11/1987 | Gomes et al. | 270/58.06 X |
| 4,720,960 | 1/1988 | Green | 270/58.06 X |
| 4,784,379 | 11/1988 | Syde et al. | 270/58.06 |
| 4,805,891 | 2/1989 | Luperti et al. . | |
| 4,875,668 | 10/1989 | Spyra . | |

FOREIGN PATENT DOCUMENTS

| | | |
|---|---|---|
| 0 102 699 | 3/1989 | European Pat. Off. . |
| 0 102 704 | 3/1989 | European Pat. Off. . |
| 0 352 687 | 1/1990 | European Pat. Off. . |
| 0 352 692 | 1/1990 | European Pat. Off. . |
| 0 556 922 | 8/1993 | European Pat. Off. . |
| 0 577 230 | 1/1995 | European Pat. Off. . |
| PS 1 000 260 | 6/1957 | Germany . |
| AS 1 013 543 | 8/1957 | Germany . |
| OS 28 11 601 | 9/1979 | Germany . |
| 648 519 | 3/1985 | Switzerland . |

OTHER PUBLICATIONS

Brochure for Böwe 650 Plastic Card System (no date).

Patents Abstracts of Japan, M–907, Dec. 14, 1989, vol. 13, No. 565, Application No. 63–60347.

*Primary Examiner*—Hoang Nguyen
*Attorney, Agent, or Firm*—Hill & Simpson

[57] ABSTRACT

An inserter system has controllable, optional delivery of sheet filling material and envelopes into which the filling material is to be inserted feeds these items from respective multiple station feeders in order to transfer a compiled set of filling material to the inserter and folding unit aligned and with identically oriented leading edges. The delivery of the filling material and envelopes for the insertion ensues without a conveyor deck and without an intermediate stop, proceeding from the programmable multiple station feeders to the folding unit integrated in the inserter. Driven, common drum arrangements for both systems serve as connecting elements between the respective multiple station feeders for filling material and envelopes. The common drum arrangement allows the connection of devices for inserting mailings given a minimization of the structural size and an increase in the reliability at the same time.

21 Claims, 5 Drawing Sheets

SHEET MATERIAL INSERTER HAVING CONTROLLABLE OPTICAL FEED OF SHEET MATERIAL AND ENVELOPES VIA MULTIPLE STATION FEEDERS

This is a continuation of application Ser. No. 08/392,223, filed Feb. 22, 1995 abandoned.

BACKGROUND OF THE INVENTION

1. Field of the Invention

The present invention is directed to a device for inserting sheet material into respective envelopes, and in particular to a device of the type having an inserter and folder unit to which the sheet material is fed from a first multiple station feeder and to which the envelopes are fed via a second multiple station feeder.

2. Description of the Prior Art

A document (sheet material) inserter having a number of feeder stations composed of a number of document feeder assemblies, an assembly for supplying envelopes and for inserting stacks of collated documents into the envelopes, as well as a conveyor for transferring the documents from the document feed assembly to the envelope feed assembly is disclosed in European Application 102704. Monitoring means for generating control signals in a machine cycle for activating and deactivating the various feed assemblies are thereby utilized. The drive of the feed assemblies ensues successively and, when a stack has been completely compiled, this stack is supplied to the envelope feed assembly without having documents remaining on the conveyor deck. In a known way, sensor units that collaborate with the central controller are employed for compiling sets of filling material in order to supply the sets in an aligned arrangement to a conveyor deck. A disadvantage is that the conveyor means disorganizes the alignment of the filling material.

It is also known to employ a microprocessor which controls the collection of documents from respective locations of a multiple station system according to predetermined criteria according to a program. The microprocessor also controls sorting of these documents and their forwarding to a folding device or to an inserter. European Application 180386 discloses an insertion system for compiling documents for insertion into envelopes which utilizes an interactive system for the selection and control of one of various possible configurations for the compilation of documents. The feed of compiled sets of filling material from the document feed assembly to the envelope feed assembly ensues with a conveyor unit that is inadequately designed for maintaining the alignment of the documents on the conveying path.

A method for inserting filling material into a wrapper, particularly into an envelope, is disclosed in German OS 33 12 087. Filling material and the wrapper are decollated from separate stacks and are conducted to an insertion station on separate conveying paths. The conveying paths must proceed essentially congruently in the insertion area, i.e. at their end regions. Control of the insertion sequence is achieved by retarding the conveying speed of the wrapper or by increasing the conveying speed of the filling material. The insertion is supported by insertion guides and alignment cams located on the conveying path.

These known devices have the disadvantage that a complicated mechanism and a complex, precise control are required.

European Application 102699 likewise discloses a universal multi-station document inserter wherein all units of the insertion system are controlled by a main control unit in conformity with a desired configuration. A set of filling material is formed in an executive sequence/stop operating mode and is forwarded as a complete set to a conveyor means.

An inserter having integrated folding device according to European Application 352692 combines the functions of feeding, folding, inserting and closing in one machine. The machine has a first conveying path for the letter, a second conveying path for the feed of empty envelopes and a third conveying path for the delivery of stuffed envelopes, whereby the filling module and the folding module are connected to one another, and thus the first conveying path is connected to the second conveying path and these two are connected to the third conveying path. The intermediate stops required on the conveying paths for the inserting or required in the separate folding units are inadequate for guaranteeing the adherence to the front-edge alignment of the filling material.

In the above discussed known devices, the fundamental design concept includes the presence of at least one conveyor deck in different embodiments thereof. A number of roller systems such as disclosed, for example, in European Application 352687 and composed of pressure rollers and counter-rollers are required in order to bring a wrapper into a defined position relative to a conveying path for printed matter, as well as in order to supply a document to the wrapper. Apart from the large amount of space required for the necessary sets of rollers, the mechanical outlay is extremely high.

European Application 556922 discloses a method for compiling documents wherein the documents are additionally stopped with a detent either on the conveying deck or in a separate folding means before the documents are forwarded as a document set. Other embodiments provide stop or detent wheels, as disclosed in U.S. Pat. Nos. 4,640,506 and 4,805,841, in order to arrest the forward motion of the supplied documents, for example in front of an inserter. As already described, an intermediate stop on the basis of detent edges, stop or detent wheels skews the alignment of the documents produced by the multiple collecting station.

SUMMARY OF THE INVENTION

An object of the present invention is to combine multiple station feeders and an inserter of the type described above with one another such that a compiled set of filling material is always guided in an aligned orientation in the inserter means and folding means and with identical leading edges, so that a continuous insertion procedure is assured given a lower space requirement and less mechanical outlay than in known systems. A further object of the invention is to achieve a substantially more compact structure with enhanced performance capability in comparison to known systems by integrating the folding unit directly into the inserter.

The above objects are achieved in accordance with the principles of the present invention in a system wherein the filling material is compiled from a programmable, multiple station feeder and is supplied with identical leading edges directly to the inserter and folding means without an intervening conveyor deck and without an intermediate stop.

More specifically the object of the invention is achieved in a system having a drum arrangement which receives the completely compiled set of filing material with identical leading edges and which is arranged in the multiple station feeder and which supplies this set directly to the inserter and folding means. A common roller arrangement fashioned in this way is also arranged between the multiple station feeder and the entry region for the envelopes in the inserter in order to also be able to forgo conveyor paths in this region.

The filling material is not arrested (retarded) in front of the inserter. By employing the common roller arrangement for the collecting procedure and for delivery to the insertion region, a conveyor deck having appropriate conveyor means is not required. The compiled documents are aligned with identical leading edges in the mail processing equipment at every point in time. Sources of error that were caused by a conveyor and by conveyor means, for example detents and stop means, are eliminated.

A direct arrangement of a folding unit directly in the inserter without additional feeder or conveyor units and without means for an intermediate stop is possible with the system of the invention.

Compared to conventional arrangements, the invention achieves a higher processing reliability and performance capability while occupying less structural space. As a result of the invention, there is the possibility of utilizing the known combination of inserter and folding means with feeders without an intermediate stop and conveyor deck and thus of having a more reliable machine that has higher performance capability and which is also more compact.

DESCRIPTION OF THE PREFERRED EMBODIMENTS

Figure 1:
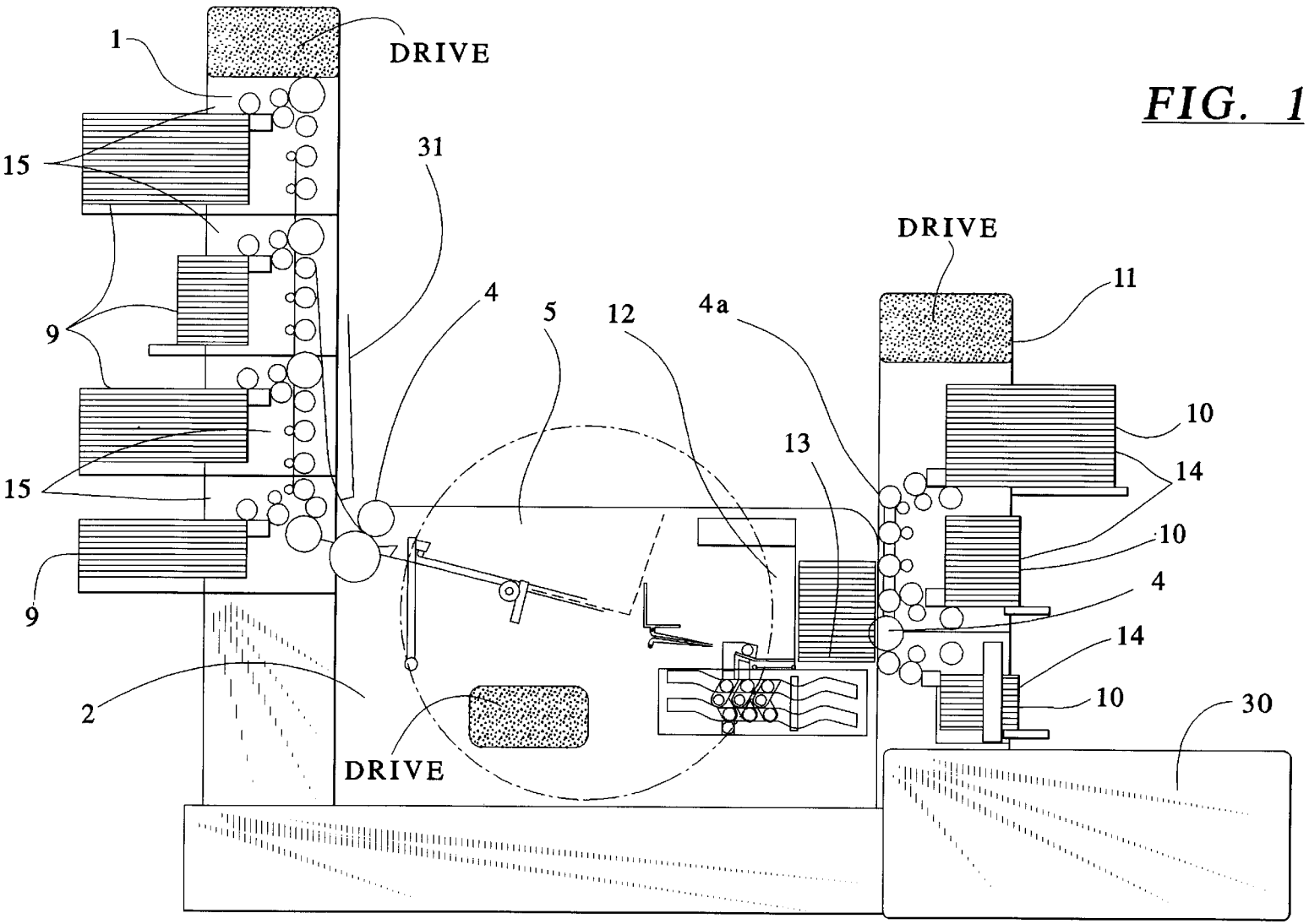
FIG. 1 shows an inserter and folding device combined with respective multiple station feeders for filling material and wrappers constructed in accordance with the principles of the present invention.

FIG. 1 shows a multiple station feeder 1 having a plurality of filling material stations 15 and shows a multiple station feeder 11 having a number of envelope stations 14. The filling material stations 15 are individually arranged horizontally above one another in the multiple station feeder 1 and accept filling material 9. The filling material stations 15 are selectively individually addressed with a central controller and the filling material is compiled to form a set with the leading edges of the sheets in the set all in registry (vertically aligned). This set is directly supplied to the inserter 2.

Changes in the working sequence can be accommodated in the apparatus of FIG. 1 as can the processing of filling materials that differ significantly with respect to number and properties. The arrangement assures the selection of an insertion envelope corresponding to the respective properties of the filling material. The envelope 10 corresponding to the filling material 9 (i.e., the envelope into which the filling material is to be inserted) is likewise automatically fed from the multiple feeder stage 11 that is composed of a number of envelope stations 14 arranged horizontally above one another.

The feed of the envelope 10 is coordinated by a central controller 45 which activates the envelope stations 14 individually and independently of one another. The envelopes 10 to be successively supplied in successive processing sequences can have different properties; correspondingly, the nature of the feed as well as the wrapper removal from the envelope station 14 can be executed in controlled fashion for specific criteria such as, for example, the thickness of the filling material. An envelope tube or holder 12 can be introduced before the admission region 13 of the inserter 2 to collect a plurality of identical envelopes 10 which are then automatically individually taken. In addition to the delivery of filling material from multiple feed devices, the arrangement also assures the manual delivery of enclosures that differ significantly in terms of their properties and, optionally, the manual delivery with a manual enclosure opening 31.

An arrangement of sensors 32 at 33 is provided at every filling material station 15 of the multiple station feeder 1. The controller 45 supplies to each station 15 via a data bus 47. Upon receipt of a start signal 50 an answerback signal 49, sets of filling material are generated simultaneously with leading edges in alignment in a known way with the output signals 51 and 52. The units are supplied with power via a power bus 48. Appropriate information is prevented on a panel display 46. The distances to be traversed by the individual filling material components are stored in the central controller 45.

The individual sheets of filling material is separated with feeder rollers 34 and separators 36 are continuously compiled with registered leading edges in the multiple station feeder 1 and are supplied by the common roller arrangement 4 directly to the admission region 5 of the inserter without an intermediate stop.

Figure 4A:
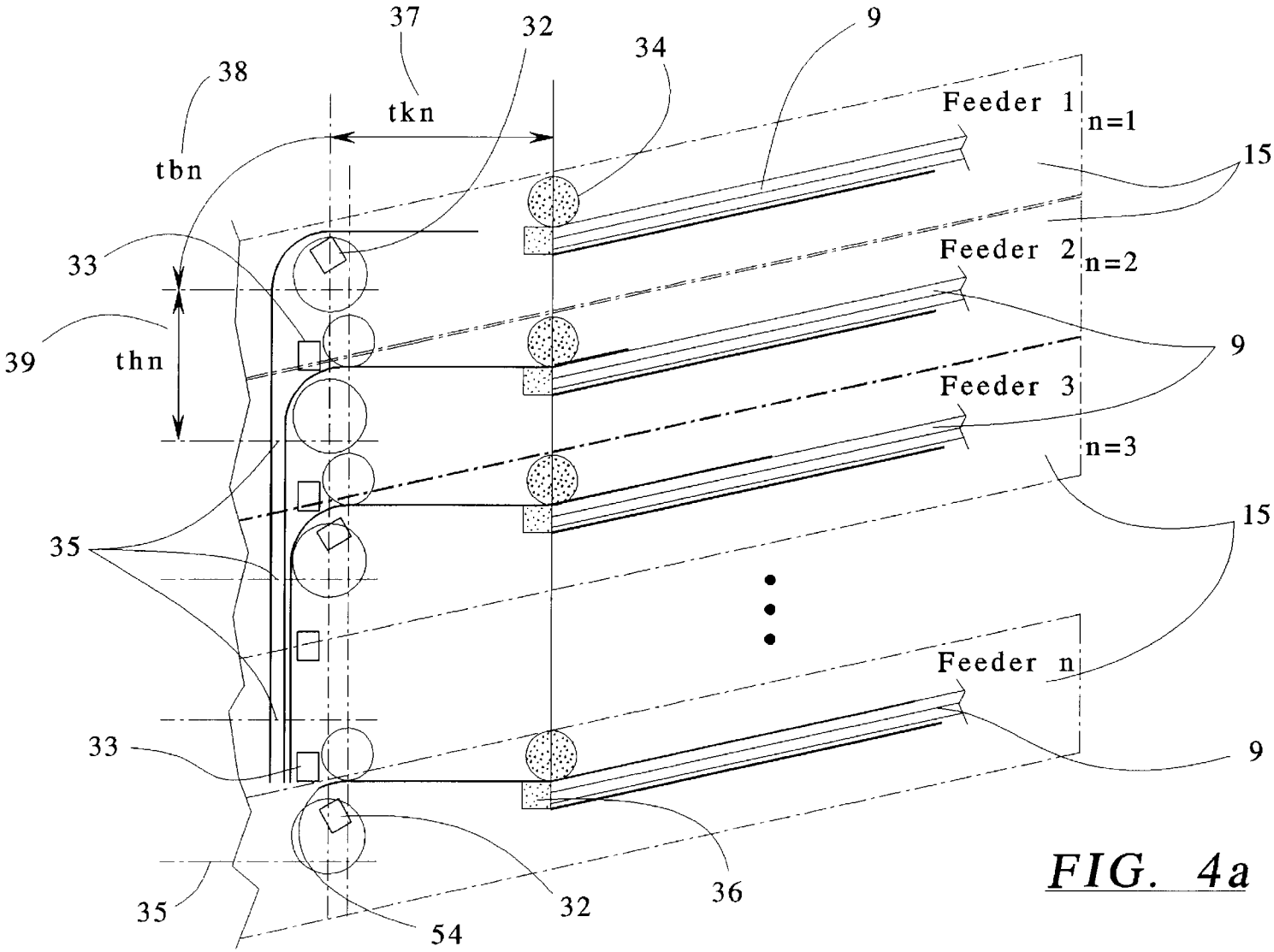
FIG. 4*a* shows a sensor arrangement for use in the multiple station feeder of the apparatus of the invention.
Figure 4B:
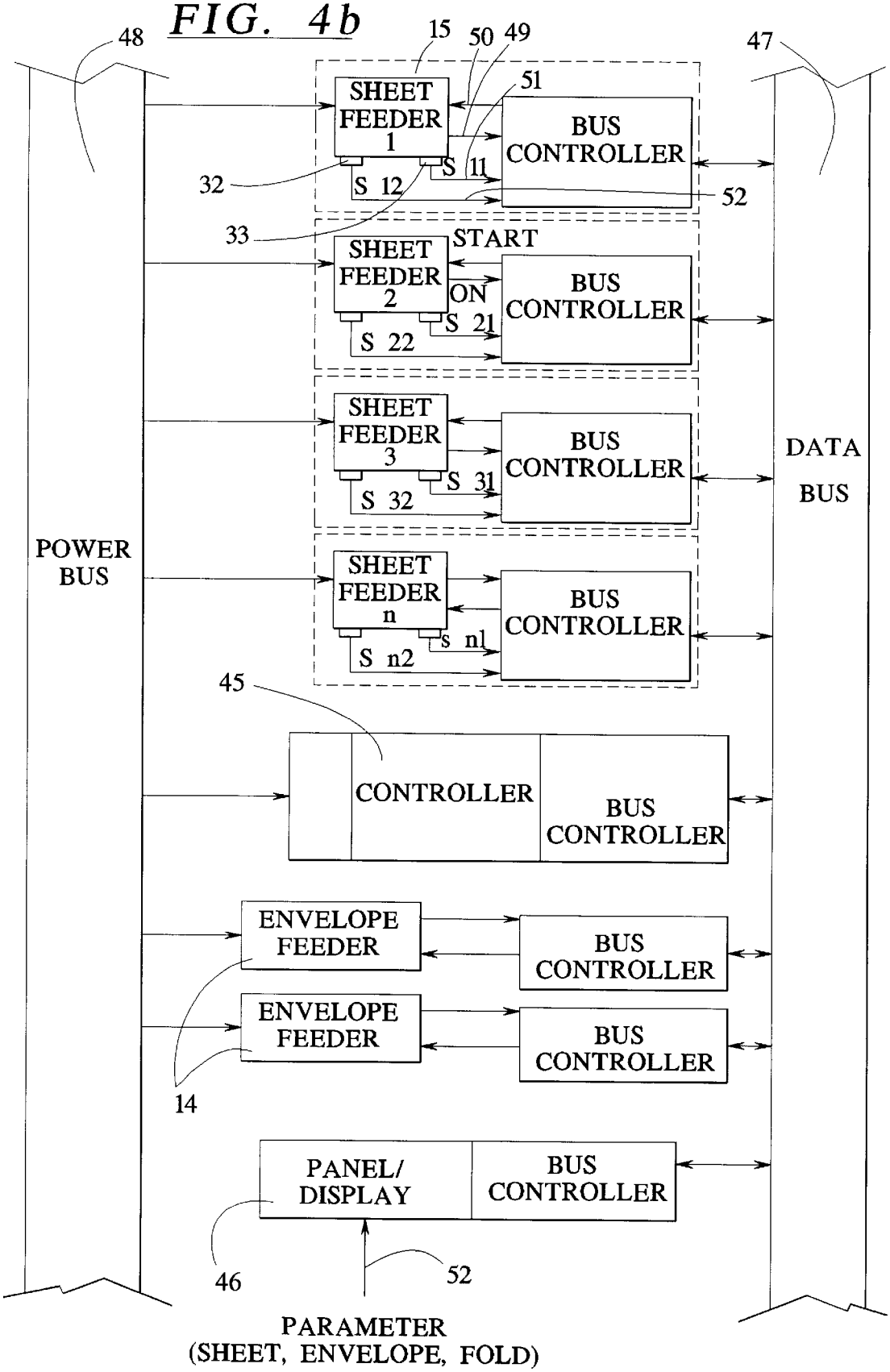
FIG. 4*b* is a block diagram of a controller for the multiple station feeder with sensor arrangement, for use in the apparatus of the invention.

It should be possible to produce a tolerance in the coincidence of the leading edges for the constituents of filling material to be compiled within a permissible offset that does not impede the further sequence of processing. This tolerance should be capable of being set dependent on different or identical dimensions and properties of the constituents of the filling material. FIG. 4*a* shows a preferred sensor arrangement that achieves this. The index n references the respective number of the filling material feeder station, counted from the top. The geometrical distance of the sensors Sn2 and s(n+1)1 from the respective point 35 at which the filling material is brought together is known. Let the leading edge registration be defined as the criterion of the deviation of a leading edge of filling material from that filling material that projects farthest from a compiled stack of filling material. The tolerance in the leading edge registration represents an allowable maximum value of the defined criterion. This can be prescribed, for example, as parameter 52 via an input module 46 that is then compared to the information calculated by the microprocessor in the controller 45 that corresponds to the temporal difference between the signals of the sensors sn2 (32) and s(n+1) 33.

The sensor sn2(32) thereby determines the position of the filling material constituent projecting farthest from the stack in the active filling material feeder station 15. The sensor s(8n+1)1, which is the first sensor in the filling material station lying directly therebelow, determines the current position of the leading edge 54 of the filling material that has just been separated and is to be added to the stack. When the identified difference exceeds the leading edge registration tolerance that has been entered, then either an error message can be triggered or feed from this filling material station is carried out earlier, or later, in the next compilation run by a time that corresponds to the amount of the measured deviation.

Since the distance to be traversed by the filling material in the individual stations is stored in a suitable way, the times 37, 38 and 39 (tkn, tbn, thn) required for the individual segments of the distance can be identified by the microprocessor in the controller 45.

The microprocessor of the controller 45 is supplied with a sensor signal 51 and 52 and evaluates the leading edge of the filling material, the length of the filling material and the delivery speed of the removed filling material 9 and correspondingly controls the permissible offset of the following feeds, so that all documents are essentially fed with identically oriented leading edges. An envelope 10 from one of the stations 14 removed from the multiple station feeder 11 is aligned synchronously with the delivery of the filling material 9 and is supplied directly to the admission region 13 of the inserter 2.

The common roller arrangements 4 and 4*a* respectively employed for the multiple removal and for the feed of the envelope constituents directly connect multiple station feeders 1 and 11 to the admission regions 5 and 13 of the inserter 2. The roller arrangement 4 receives the compiled set of filling material 9 from the roller arrangement of the multiple station feeder 1 as soon as it has passed the last filling material station 15, and the roller arrangement 4*a* receives the envelope 10 from the roller arrangement of the multiple station feeder 11, at a time predetermined for the filling event, for forwarding to the inserter 2. Each roller arrangement 4 and 4*a* has one or more belts which are driven by the rollers in opposite directions to transfer the respective sheets of filler material or envelopes. The opposed belts in each arrangement can be merged together by means of spring biasing of the individual rollers. The rollers may, however, be provided with a surface coating which would avoid the necessity of using a belt. For example, the roller surfaces may each be elastically resilient, or may be provided with different surface coatings for accommodating different types of sheet material or envelopes. The rollers in each of the roller arrangements 4 and 4*a* may be respectively separately driven by their own, dedicated drive, or one or both of the arrangements 4 and 4*a* can be operated by the same drive which operates the inserter 2.

The filling material 9 is first folded in the inserter and folding device and is subsequently inserted into the envelope 10. The folding and stuffing unit 18 of FIG. 3 successively produces the folding flap fold 9*a* and the stuffer/folding funnel fold 9*b*. When producing the stuffer/folding funnel fold 9*b* with the stuffer 18*a* and the folding funnel 21, the filling material 9 is simultaneously stuffed into the opened envelope 10. The collaborating inserter units thereby already move relatively toward one another when folding the second fold in the inserter 2. This relative motion only ends after the filling of the envelope 10 with the folded filling material 9. It is also possible to forgo the second fold 9*b* and to produce only a single fold. To this end, the stuffer 18*a* can have a suitable dog 42 for the trailing edge of the filling material that grasps the filling material folded once by the folding flap 9*a* at its trailing edge and moves it into the insertion envelope 10. Employing an apparatus that does not fold but that has the advantages of the described invention is likewise possible, as shown in FIG. 3. Such an arrangement has slotted catch hook 40 through which the trailing edge dog 42 moves in order to grasp the filling material at the filling material edge 43.

The common roller arrangements 4 and 4*a* are operated either with a central drive or with a plurality of drives that are separate from one another for the feed and insertion sequences. The filled envelopes are then ejected into a following device 30.

Figure 2:
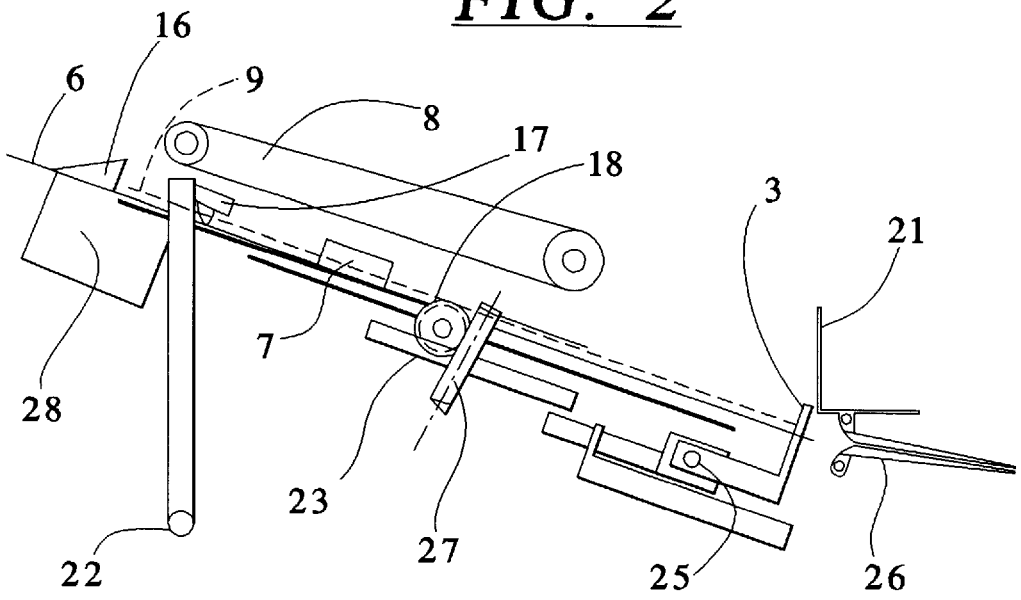
FIG. 2 illustrates the inserting and folding portion of the apparatus of FIG. 1 in more detail.

Details of one embodiment of the inserter are shown in FIG. 2.

The apparatus shown in FIG. 2 is a folding unit as disclosed, for example, in German OS 4220404. The folding unit is arranged immediately in the inserter.

The insertion region of the inserter and folding means has an acceptance plate 6 having a centering arrangement 16 and guide element 7 for guiding the filling material 9, whereby a detent element 3 is arranged at the acceptance plate 6 at that end lying opposite the centering arrangement 16 and a folding funnel 21 is arranged opposite the detent element 3. The opener 26 for the insertion envelope is secured immediately at the folding funnel 21. The detent element 3 has an adjustment assembly 25 which permits the detent element 3 to be tilted around a rotational axis 41, or some other suitable arrangement. A slide element 24 is provided for adjusting longitudinal position of the detent element 3. Preferably, the detent element 3 is arranged directly inside the inserter and under the folding and stuffing unit 18.

A hold-down assembly 8 serves the purpose of guiding the filling material from above. The hold-down assembly 8, however, does not retard the filling material 9 and does not restrain it. There is a small gap (exaggerated in FIG. 2) greater than the thickness of the filling material 9 present between the acceptance plate 6 and the hold-down assembly 8. The centering arrangement 16 and the guide elements 7 interact with the hold-down assembly 8 in order to guide the filling material 9 directly against the detent element 3. The filling material 9 is arrested at the detent element 3 with identical leading edges with this arrangement. The folding and stuffing unit 18 is composed of a folding flap 18*b* having a slide 18*a* and of the stationary acceptance plate 6. As may be seen from FIG. 2, the folding and stuffing unit 18 has a dog 17 for the slide 18*a* that is secured to the bearing 22. An optical edge monitor 28 below the centering arrangement 16 recognizes the set of filling material that is supplied and triggers the folding event, as shown in FIG. 3. The folding flap 18*b* is operated by a folding flap drive 23 that can pivot a folding finger 19 away via a folding finger axis 27. The vertical dislocation of the slide 18*a* ensues on the basis of a dog 17 secured to the bearing 22.

The set of filling material is received by the folding and stuffing unit 18 and is arrested with identical leading edges by the detent element 3. The folding and stuffing unit 18 resides under the set of filling material in the initial position. By turning the folding flap 18*b*, the set of filling material is folded a first time with the folding finger 19.

Parallel to the folding event, the envelope 10 accepted by the inserter folder 2 and is opened by an envelope opener 26 and the filling material 9 is thrust into the insertion envelope by the slide that forms the second fold with the folding funnel 21.

Figure 3A:
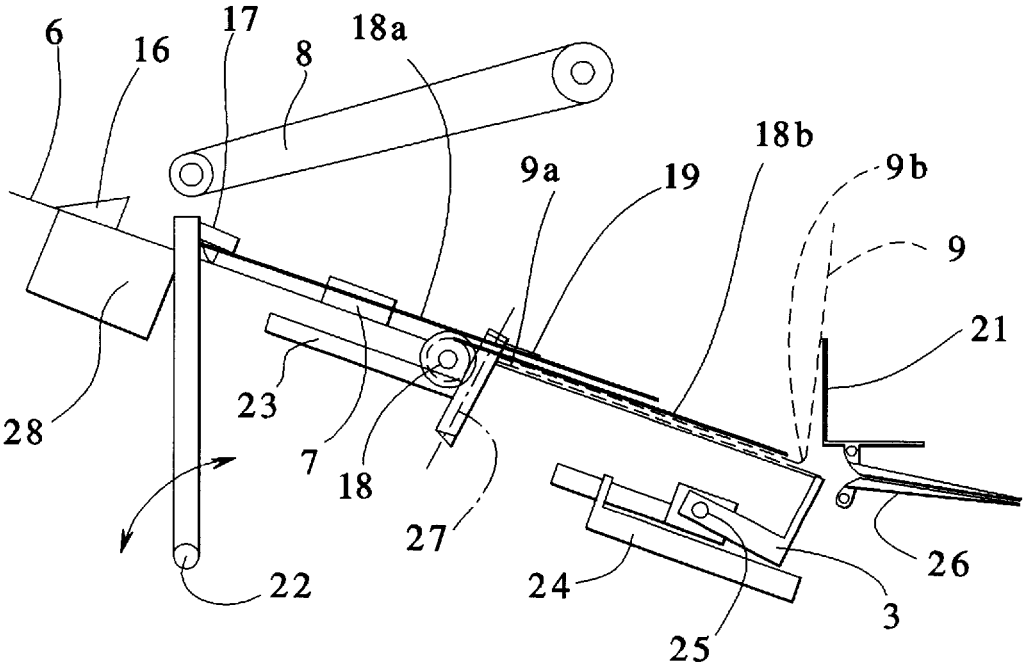
FIG. 3*a* illustrates the inserter and folding unit of FIG. 2 in a different phase of its operating sequence.
Figure 3B:
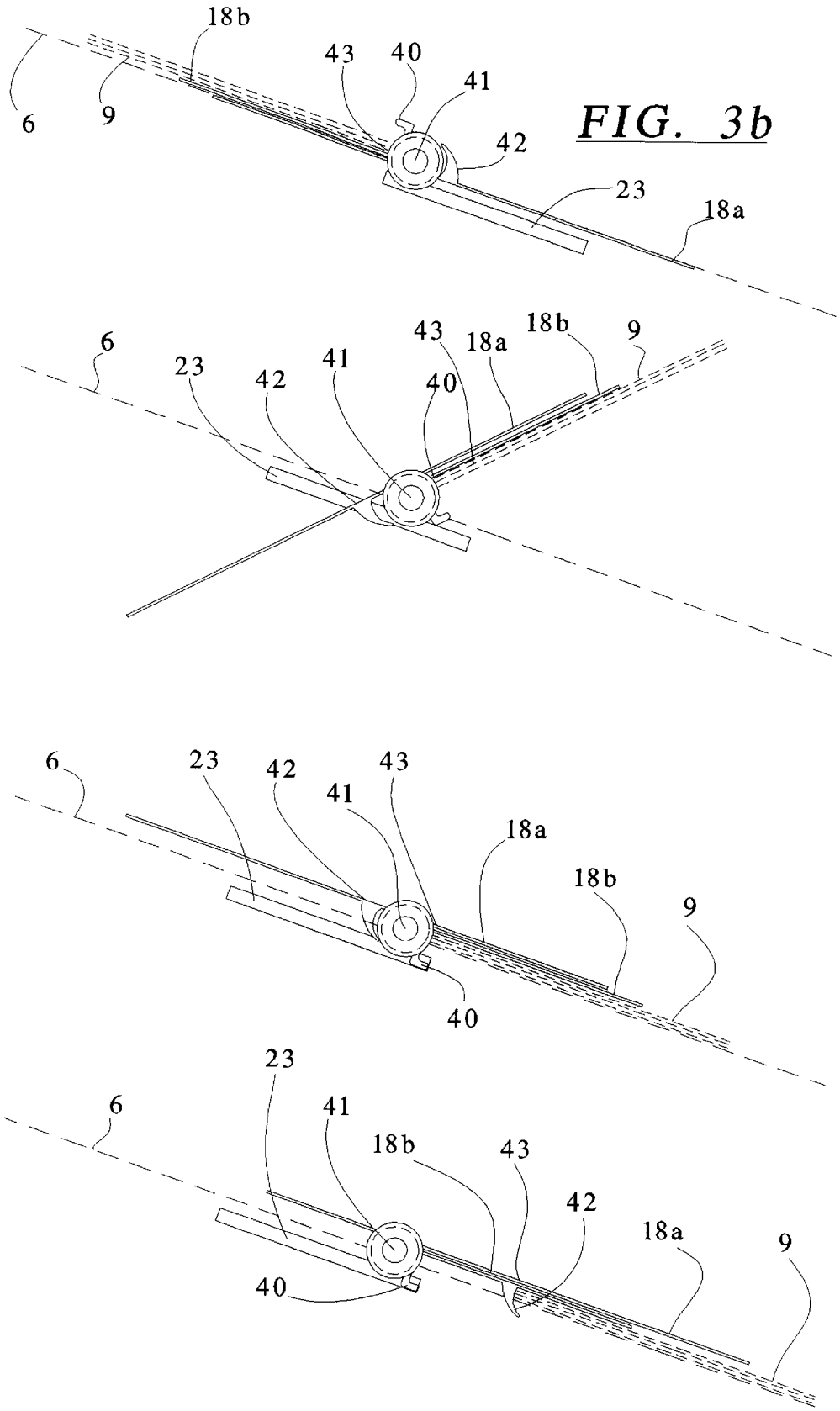
FIG. 3*b* shows a stuffer and folding means with trailing edge dog useable in the apparatus of the inventor.

FIG. 3*a* shows the inserter and folding means 2 in a different phase of the sequence. FIG. 3*b* shows a stuffing machine and folding means given a non-folding or single-folding mode in various motion phases. The catch hook 40 is additionally shown, this being located at the folding flap 18*b*. An arrangement is also possible wherein the catch hook is located at the acceptance plate 6, preferably pivotable away therefrom. The slide 18 is also equipped with a trailing edge dog 42.

The folding and stuffing unit 18 enables the production of a fold, for example of a Z-fold, volute fold or simple fold of the filling material 9 directly in the inserter. The position of the fold can be directly set on the basis of a suitable adjustment of the detent element 3 that arrests the supplied filling material in the inserter. The folding event is triggered after the selected number of individual documents has been compiled to form a set and this set has passed the edge monitor 28. Parallel with the folding event of the first fold 9*a* with the folding finger 19 and folding flap 18*b*, the envelope 10 is opened with the envelope opener 26 and the filling material 9 is stuffed into the envelope by the slide 18*a* that forms the second fold 9*b* together with the folding funnel 21. The filled envelope is then supplied to a following device, for example to a closing device or sorting unit (device 30 in FIG. 1). It is also possible to catch formats, for example 4", with the folding flap 9*a* on the basis of suitable catch hooks that are secured at the level of the pivot point of the folding and stuffing unit 18 and to turn them over. After they have been turned over, a trailing edge dog moves through a slot of the catch hook and pushes the filling material 9 in the direction of the insertion envelope 10.

The described execution, wherein the filling material is conducted to the envelope, is to be understood merely as a possible embodiment. Reversing the motion is likewise possible, as is an implementation wherein the filling material and envelopes move toward one another in relative fashion.

Although modifications and changes may be suggested by those skilled in the art, it is the intention of the inventors to embody within the patent warranted hereon all changes and modifications as reasonably and properly come within the scope of their contribution to the art.

We claim as our invention:

1. An apparatus for repeatedly inserting sheet filling material into respective envelopes, comprising:

a first multiple station feeder having a plurality of stations each having a stack of sheet filler material;

a second multiple station feeder having a plurality of stations each having a stack of envelopes;

inserter means for receiving a collated stack of filler material from said first multiple station feeder via a first input in a first direction with all leading edges of the sheets of filler material in said collated stack being identically oriented and for receiving an envelope from said second multiple station feeder via a second input, remote from said first input, in a second direction opposite said first direction, for inserting said collated stack into said envelope with no retardation of said filling material or said envelope; and said first and second multiple station feeders being respectively directly connected to said first and second inputs of said inserter means with no intervening transport mechanism between said first multiple station feeder and said first input and no intervening transport mechanism between said second multiple station feeder and said second input.

2. An apparatus as claimed in claim 1 wherein said first multiple station feeder comprises first roller means for removing respective sheets of filler material from the respective stations in said first multiple station feeder and for advancing said sheets of filler material to said first input, and wherein said second multiple station feeder comprises second roller means for removing an envelope from one of said stations in said second multiple station feeder and for transferring said envelope to said second input.

3. An apparatus as claimed in claim 2 wherein each of said first and second roller means in said first and second multiple station feeders comprises a plurality of rollers, each roller having an elastically resilient surface.

4. An apparatus as claimed in claim 2 wherein each of said first and second roller means in said first and second multiple station feeders comprises a plurality of rollers, with some rollers in each plurality of rollers having a different surface material than other rollers in said plurality.

5. An apparatus as claimed in claim 2 wherein each of said first and second roller means in said first and second multiple station feeders comprises a plurality of rollers and oppositely running continuous belts respectively entrained around said rollers.

6. An apparatus as claimed in claim 1 comprising common drive means for operating said inserter means and said first multiple station feeder.

7. An apparatus as claimed in claim 1 further comprising common drive means for operating said inserter means and said second multiple station feeder.

8. An apparatus as claimed in claim 1 comprising first drive means for operating said inserter means and second drive means separate from said first drive means, for operating said first multiple station feeder.

9. An apparatus as claimed in claim 1 further comprising first drive means for operating said inserter means, and second drive means, separate from said first drive means, for operating said second multiple station feeder.

10. An apparatus as claimed in claim 1 wherein said inserter means contains folding means for folding said collated stack of filler material prior to inserting said collated stack into said envelope.

11. An apparatus as claimed in claim 10 further comprising:

an acceptance plate having guide elements for said collated stack of filler material;

a hold-down assembly disposed over said acceptance plate;

said acceptance plate and said hold-down assembly being disposed between said first input and said folding means; and detent means, disposed after said folding means, for stopping the folded stack of collated filler material after it has been folded by said folding means.

12. An apparatus as claimed in claim 11 wherein said detent means comprises a stop element and means for adjusting a position of said stop element relative to said folding means.

13. An apparatus as claimed in claim 12 wherein said detent means comprises means for pivoting said stop around a rotational axis and for longitudinally adjusting the position of said stop element.

14. An apparatus as claimed in claim 11 further comprising means for adjusting a position of said detent means for cooperating with said means for folding to set a selected type of fold.

15. An apparatus as claimed in claim 10 wherein said folding means comprises means for selectively folding said collated stack in one of a plurality of different types of folds.

16. An apparatus as claimed in claim 10 further comprising means for collecting filler material folded by said means for folding.

17. An apparatus as claimed in claim 1 further comprising means for manually feeding envelopes into said inserter means.

18. An apparatus as claimed in claim 1 further comprising sensor means for sensing a leading edge of said filler material in said inserter means and means for setting an offset of filling material in said inserter means dependent on a signal from said sensor.

19. An apparatus as claimed in claim 1 further comprising sensing means for sensing a characteristic of said filling material in said inserter means and for controlling selection of an envelope from said second multiple station feeder means matched to the characteristics of said filling material.

20. An apparatus as claimed in claim 1 wherein said inserter means comprises folding flap means for operating on filler material in said collated stack for selectively producing one of Z-fold, a volute fold or a simple fold.

21. An apparatus as claimed in claim 19 wherein said inserter means further comprises means for rotating said filler material around a pivot point, and further comprising a trailing edge dog movable in a direction toward an edge of said filler material through a slot in a catch hook.

* * * * *